United States Patent [19]

Small et al.

[11] Patent Number: 4,462,039

[45] Date of Patent: Jul. 24, 1984

[54] PLASTIC IDENTIFICATION CARD HAVING AN IMPROVED SIGNATURE PANEL

[75] Inventors: Edward A. Small, Nepean; Geoff C. Wright, Ottawa, both of Canada

[73] Assignee: British American Bank Note Inc., Ottawa, Canada

[21] Appl. No.: 439,830

[22] Filed: Nov. 8, 1982

[30] Foreign Application Priority Data

Dec. 14, 1981 [CA] Canada ..... 392198

[51] Int. Cl.[3] ..... B41M 5/16; B41M 5/22

[52] U.S. Cl. ..... 346/206; 283/94; 283/95; 283/98; 283/107; 283/108; 283/109; 283/110; 283/111; 283/901; 283/904; 346/226; 427/7; 427/150; 427/151; 427/152; 427/258; 428/172; 428/915; 428/916

[58] Field of Search ..... 162/134, 140, 162; 283/91, 94, 901, 904, 95, 98, 107–111; 427/7, 150–152, 258, 261, 265; 428/195, 207, 211, 212, 916, 156, 166, 172, 173, 411, 488, 913–915; 282/27.5

[56] References Cited

U.S. PATENT DOCUMENTS 4,109,047 8/1978 Fredrickson ..... 428/916

FOREIGN PATENT DOCUMENTS 1598702 9/1981 United Kingdom ..... 346/226
2084930A 4/1982 United Kingdom ..... 346/226

OTHER PUBLICATIONS

Godlewski, "Safety Paper", I.B.M. Tech. Discl. Bull., vol. 15, No. 11, Apr. 1973.
Herron, "Credit Card Signature Panel", I.B.M. Tech. Discl. Bull., vol. 17, No. 7, Dec. 1974.

*Primary Examiner*—Bruce H. Hess
*Attorney, Agent, or Firm*—Cushman, Darby & Cushman

[57] ABSTRACT

This invention relates to a plastic identification card with an improved signature panel. There is a problem with existig credit cards in that the existing signature can be obscured by printing over with a patch of clay composition similar to that used to provide the original signature panel. A new signature can then be applied. This problem is overcome by providing a signature panel which is sandwiched between the core stock and a protective transparent film. The signature panel comprises a layer of chemicals reactive under the pressure of a signature to release a colored dye conforming with the signature.

7 Claims, 7 Drawing Figures

PLASTIC IDENTIFICATION CARD HAVING AN IMPROVED SIGNATURE PANEL

This invention relates to a plastic identification card and particularly to a plastic identification card having a signature panel. Plastic identification cards include credit cards and similar cards such as debit cards, insurance cards, transaction cards and the like. For convenience in the following description, the cards will be referred to as credit cards.

Conventional credit cards comprise a core stock, usually of plastic such as polyvinyl chloride mylar or styrene, usually with but not always embossed surfaces with the name, card number and other embossed or non-embossed information, such as conditions of use. At least one side is usually protected by a plastic layer such as a transparent polyvinyl chloride film or a coating such as acrylic polymer. Signature panels are now being used to an increasing extent and these are formed by printing a rectangular patch on the outer surface of the transparent film with a clay or clear composition ink. This patch of composition ink will receive a signature. The theory is that an attempt to replace the signature with another signature will damage the surface of the composition ink.

A problem with existing credit cards of the type referred to in the preceding paragraph is that sophisticated forgers are now laying another layer of clay composition ink or other material over the original signature panel thereby covering it and providing a fresh receptive surface for a new signature. Sometimes the forger will remove the signature panel and lay down a fresh layer. It is most difficult to detect a card which has been tampered with in this manner. Another problem is that particularly where a ball-point pen has been used, it may be possible to remove the signature with a solvent.

The object of this is to prevent the signature being changed in the foregoing manner.

In accordance with this invention, the signature is positioned in the interior of the card so that it cannot be tampered with, without partial destruction of the card. This is achieved by locating a signature panel between the core stock and the conventional transparent film covering a surface of the core stock. The signature panel comprises a layer of chemicals reactive under the pressure of a signature to release a coloured dye conforming with the signature. This then means that the signature will develop beneath the transparent plastic film. It may also appear on the surface. Tampering without visible signs that this has occurred will be far more difficult because of the possible release of additional dye in the signature area if pressure is exerted during attempts to remove the plastic film. It will not be possible merely to cover the existing signature by printing over it wil a clay composition ink, or laying other material without the credit card being an obvious false document.

In the drawings which illustrate the preferred embodiments:

Figure 1:
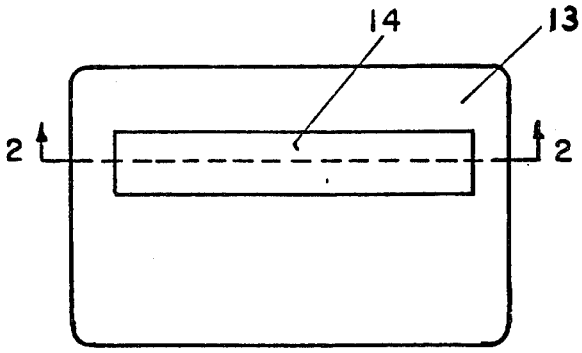
FIG. 1 is a plan view of the back of a credit card.
Figure 2:
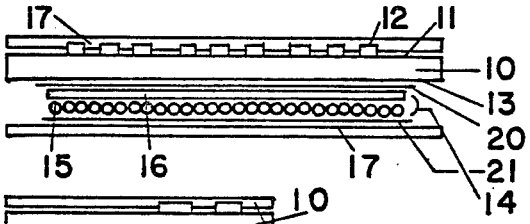
FIG. 2 is a section view of the line 2—2 of FIG. 1 with the layers separated for convenience of illustration.

The credit card illustrated in FIGS. 1 and 2 comprises a core stock 10 having on its front surface 11 a transparent plastic film 17 and conventional embossments 12 providing information as to the serial number of the card and the name of the user. There may also be other non-embossed printing (not shown) on the face of the card. On the reverse side 13 of the core stock there is a signature panel 14 which in this embodiment comprises a capsule coat 15 and a receptive coat 16. Capsule coat 15 is a layer of colourless liquid encased in tiny capsules known as microcapsules. Under pressure the liquid is released from the capsules resulting in a localized chemical reaction within the receptive coat 16. The colourless liquid in the microcapsules are colour formers such as crystal violet lactone and/or benzoleucomathylene blue insolution in suitable colourless high boiling solvents. Crystal violet lactone undergoes a reaction in which the lactone ring is opened and a positive charge appears on one of the nitrogen atoms, thus forming the dyestuff known as crystal violet. Similarly, benzoleucomathylene blue will form a turquoise dye. There are now numerous proprietary colour formers that are commercially available. Various techniques are used for forming the microcapsules which may be classified under the headings coacervation, interface, polycondensation and solvent-induced polymer deposition. These are discussed in more detail in the general literature such as an article entitled "Chemical Carbonless Papers" a paper by J. M. Collins published in Professional Printer, Volume 24, No. 3 of 1981. The receptive coating may be a reactive clay which has been subjected to chemical treatment to provide reaction with the colour former, clays having added phenolic resins or zinc salicylate.

Figure 2A:
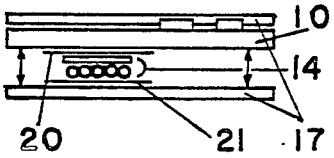
FIG. 2A is a similar section view on a line perpendicular to line 2—2.

In FIGS. 1 and 2, a film of plastic 17 such as transparent polyvinyl chloride is then applied to the back surface of the core stock completely to cover at least the signature panel 14. Preferably a plastic film or coating covers the entire back of the card to provide a transparent layer. However, the signature panel is sandwiched between the core stock and the plastic film or coating instead of being exposed on the outer surface as in previous practice. Although for convenience of illustration film 17 is shown in FIGS. 2 and 2A as being separate from core stock 10, it will of course be firmly adhered thereto as shown by arrows in FIG. 2A. An adhesive layer 20 secures the signature panel to the core stock. A blocking layer 21 prevents the monomers from the acrylic coating from neutralizing the activated clay.

Figure 3:
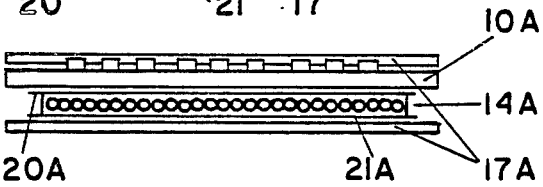
FIG. 3 is a similar section line to FIG. 2 illustrating an alternative embodiment of the invention.

FIG. 3 illustrates an alternative and preferred embodiment comprising a core stock 10A, and a plastic film or coating 17A covering a signature panel 14A. In this instance, signature panel 14A comprises a single layer of reactive coating of the type used in self-imaging papers. Both the colour former and the chemical which reacts with the colour former to release the dye are in this single coating. As an example, 4 parts of a commercially available powder of the type used in self-imaging paper and which includes a mixture of colour former and reaction chemical such as the material sold by B.A.S.F. under the designation B. 40, is mixed with 2 parts of activated clay which should have a particle size slightly greater than the capsules of the powder. A suitable clay is known under the trademark COPISIL. These are then mixed with 1 part of a solvent such as methanol and 3 parts of a mixture of resin binders such as the acrylic resing known under the trademark ACRONOL S320D and JONCRYL 85 in the ratio of 5:4. About 1 part of water is added to reduce the viscosity. The resultant mixture is then printed, preferably by screen printing, with a 160–200 mesh screen, to provide a signature patch on a core stock of plastic such as polyvinyl chloride, which core stock is preferably precoated with an adhesive such as an acrylic ethyl acetate 20A. The signature panel after printing is protected with a blocking compound 21A such as latex adhesive, activated clay and water in the ratio 7:1:2 to prevent monomers from the acrylic coating from neutralizing the activated clay in the signature panel. A transparent plastic film or coating such as an acrylic resin is then applied to cover the signature patch. The core stock will typically have a thickness of 7 to 23 mil. The printed signature panel will have a thickness of 2 to 5 microns. The transparent coating may have a thickness of about 5 to 15 and preferably 10 microns. The acrylic resin coating on the signature panel should not be cured under undue heat or pressure, as this may cause discolouration. The preferred method is to use ultra violet light. But ultra violet light may cause bleaching of the dye unless a suitable blocking agent 21, 21A or 21B for the dye is selected.

Figure 4:
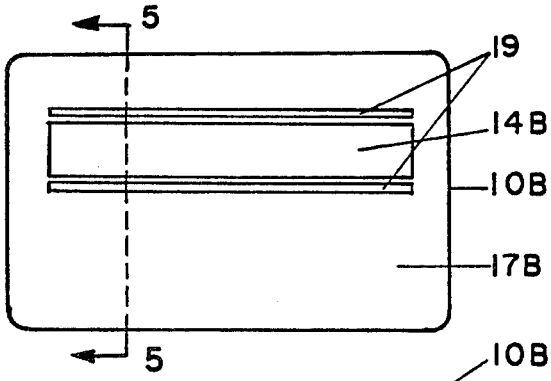
FIG. 4 is a plan view of a credit card showing a further alternative embodiment.
Figure 5:
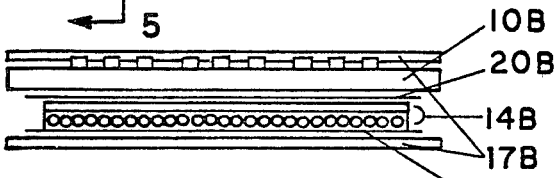
FIG. 5 is a section view on a line perpendicular to line 5—5.
Figure 5A:
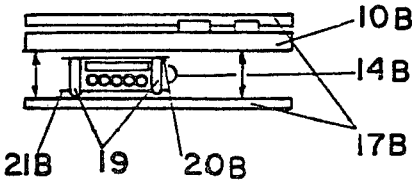
FIG. 5A is a section view on the line 5—5 of FIG. 4.

The credit card in FIGS. 4 and 5 is similar to that in FIG. 3 and comprises a core stock 10B, a protective layer of plastic 17B, a signature panel 14B, adhesive layer 20B and blocking layer 21B. In this embodiment, however, there is provided an embossed frame 19 which may be in the form of a parallel embossment close to the long edges of signature panel 14B. This is to provide added protection to prevent undue pressure on the signature panel during use of the credit card.

The result will be a credit card in which the signature is protected by being sandwiched within the layers of the card.

We claim:

1. An identification card comprising a core stock, a signature panel of a layer of chemicals reactive under pressure to form a dye in a single layer so as to be self-imaging printed on the core stock, a layer of a blocking compound on said layer of chemicals to protect said chemicals from a subsequently applied coating and a coating of polymer which covers and adheres to at least said signature panel.

2. An identification card as in claim 1 in which the polymer coating is an acrylic polymer.

3. An identification card comprising a core stock, a signature panel on a surface of said core stock and a transparent plastic layer covering at least said signature panel, said signature panel comprising at least one layer of chemicals reactive under the pressure of a signature to release a coloured dye conforming with said signature, said signature panel being framed with an embossment to protect the signature panel during use of the credit card.

4. A method of making an identification card comprising applying to a core stock a patch of chemicals reactive under pressure to form a dye in a single layer so as to be self-imaging, said patch being of sufficient size to provide a signature panel, applying a blocking compound adapted to protect the self-imaging reactive chemicals from the monomer in a subsequently applied coating, then applying a coating of a monomer polymerizable to a transparent layer and polymerizing said coating, said application and polymerization steps being conducted without the application of heat or pressure sufficient to affect the self-imaging material.

5. A method as in claim 4 in which the monomer is acrylic monomer.

6. A method as in claim 4 in which the application steps are by screen printing.

7. A method as in claim 4 in which the polymerization step is accomplished by ultra violet light.

* * * * *

UNITED STATES PATENT AND TRADEMARK OFFICE

CERTIFICATE OF CORRECTION

PATENT NO. : 4,462,039

DATED : Jul. 24, 1984

INVENTOR(S) : Small et al.

It is certified that error appears in the above—identified patent and that said Letters Patent is hereby corrected as shown below:

On the title page, after "Foreign Application Priority Data", insert -- Sep. 21, 1982 [CA] Canada ..... .....411820 --.

On the title page, in the Abstract, line 3, change "existig" to --existing--.

Column 1, line 56, change "wil" to --with--.

Signed and Sealed this

*Nineteenth* Day of *February 1985*

[SEAL]

*Attest:*

DONALD J. QUIGG

*Attesting Officer* *Acting Commissioner of Patents and Trademarks*